US005840671A

United States Patent [19]

Fujimura et al.

[11] Patent Number: 5,840,671

[45] Date of Patent: Nov. 24, 1998

[54] CLEANING SOLUTION FOR CONTACT LENS EXHIBITING EXCELLENT DETERGENCY

[75] Inventors: Atumi Fujimura, Kakamigahara; Kaoru Kamiya, Nishikasugai-gun; Shinji Tanaka, Ichinomiya, all of Japan

[73] Assignee: Tomey Technology Corporation, Japan

[21] Appl. No.: 569,450

[22] Filed: Dec. 8, 1995

[30] Foreign Application Priority Data

Dec. 15, 1994 [JP] Japan ..... 6-312009

[51] Int. Cl.[6] ..... C11D 1/75; C11D 1/12; C11D 1/62; C11D 1/94

[52] U.S. Cl. ..... 510/112; 510/119; 510/123; 510/124; 510/125; 510/130; 510/131; 510/127; 510/405; 510/409; 510/414

[58] Field of Search ..... 510/119, 123, 510/124, 125, 112, 130, 131, 127, 405, 409, 414

[56] References Cited

U.S. PATENT DOCUMENTS 4,337,165 6/1982 Ando et al. ..... 252/105
4,479,893 10/1984 Hirota et al. ..... 252/542
4,814,109 3/1989 Wittpenn, Jr. et al. .
5,165,918 11/1992 Heyl et al. ..... 424/78.04
5,190,594 3/1993 Chou et al. ..... 134/6

FOREIGN PATENT DOCUMENTS 0427548 5/1991 European Pat. Off. .
2101350 1/1983 United Kingdom .

*Primary Examiner*—Paul Lieberman
*Assistant Examiner*—Charles Boyer
*Attorney, Agent, or Firm*—Parkhurst & Wendel, L.L.P.

[57] ABSTRACT

A cleaning solution for cleaning a contact lens, which includes at least one first component each consisting of a tertiary amine oxide which is represented by the formula given in the specification and at least one second component each consisting of an anionic surface active agent in the form of a triethanolamine salt, a total content of the at least one first component and the at least one second component being within a range of 0.1–20% by weight, a ratio of a total content of the at least one first component to a total content of the at least one second component being within a range from 1/4 to 30/1.

17 Claims, No Drawings

CLEANING SOLUTION FOR CONTACT LENS EXHIBITING EXCELLENT DETERGENCY

BACKGROUND OF THE INVENTION

1. Field of the Invention

The present invention relates in general to a cleaning liquid or solution for a contact lens, and more particularly to such a contact lens cleaning solution which is capable of effectively removing a lipid adhering to the surfaces of the contact lens, and which reduces irritation to the skin of hands of the user.

2. Discussion of the Prior Art

Generally, a contact lens is liable to be stained with a secretion such as protein or lipid which is included in the tear fluid and which adheres to the surfaces of the contact lens while the contact lens is worn on an eye of the user. In handling or cleaning the contact lens, sebum (skin oil) or cosmetics adhering to the hands of the user tend to soil the contact lens. If the contact lens is kept worn on the eye of the user with the stain such as protein, lipid or cosmetics adhering to the contact lens, the contact lens suffers from deteriorated water wettability or hydrophilicity and lowered oxygen permeability, causing considerable discomfort to the lens wearer. In addition, the lens wearer may suffer from deterioration in his eyesight, pain in the eye, hyperemia or congestion of the eye, due to the continuous wearing of the stained contact lens. In view of this, it is critical to completely remove the stain adhering to the contact lens surfaces for safe and comfortable wearing of the contact lens on the user's eye.

There are proposed various kinds or types of a cleaning liquid or solution for a contact lens, which aim at removing the stain adhering to the surfaces of the contact lens as described above. One example of such a cleaning solution is disclosed in JP-A-5-202383, wherein the cleaning solution contains a particular amphoteric surface active agent, one or more kinds of an anionic surface active agent and/or one or more kinds of a cationic surface active agent. However, the proposed cleaning solution does not provide a sufficient cleaning effect or detergency beyond the stain removal capability to be exhibited by each of those surface active agents included in the cleaning solution. In particular, cleaning effect tests show that the cleaning solution according to the publication is not capable of exhibiting a satisfactory cleaning effect with respect to a lipid composition which is considered to be most similar to the stain which usually adheres to the contact lens.

SUMMARY OF THE INVENTION

The present invention was developed in view of the above-described prior art situation. It is therefore an object of the invention to provide a cleaning solution for a contact lens, which cleaning solution exhibits a high degree of cleaning effect to various kinds of stains such as lipid or cosmetic composition which adhere to the surfaces of the contact lens during use or handling thereof, and which cleaning solution reduces irritation or harm to the skin of the user.

The present inventors have made an extensive research on the contact lens cleaning solution in an effort to achieve the above-indicated object, and found that a cleaning solution exhibits a significantly improved cleaning effect when the cleaning solution contains a specific amphoteric surface active agent and a specific anionic surface active agent in a predetermined ratio.

The above object may be attained according to the principle of the present invention which provides a cleaning solution for cleaning a contact lens, which includes at least one first component each consisting of a tertiary amine oxide which is represented by the following formula,

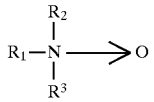

wherein, $R_1$ represents an alkyl group having 12–18 carbon atoms while each of $R_2$ and $R_3$ represents an alkyl or hydroxyalkyl group having 1–2 carbon atoms, the $R_2$ and $R_3$ being in the same group or in different groups, and at least one second component each consisting of an anionic surface active agent in the form of a triethanolamine salt, a total content of the at least one first component and the at least one second component being within a range of 0.1–20% by weight, a ratio of a total content of the at least one first component to a total content of the at least one second component being within a range from 1/4 to 30/1.

The contact lens cleaning solution according to the present invention comprises the tertiary amine oxide or oxides (at least one first component) as an amphoteric surface active agent and the triethanolamine salt or salts (at least one second component) as the anionic surface active agent, in the predetermined ratio as described above. The present cleaning solution wherein the two different kinds of surface active agents are employed in combination is capable of exhibiting a higher degree of cleaning effect than any cleaning solution which employs only one of those two kinds of surface active agents. Accordingly, the present contact lens cleaning solution assures effective removal of the stains such as the lipid included in the tear fluid, or cosmetic compositions, which were not adequately removed by the conventional cleaning solution.

The tertiary amine oxide employed as each of the at least one first component in the form of amphoteric surface active agent in the present cleaning solution is effective to reduce an unfavorable action of the anionic surface active agent employed as each of the at least one second component. That is, the present cleaning solution favorably reduces the harm and irritation to the contact lens and the skin of the user.

Accordingly, the present contact lens cleaning solution assures the user of safe and comfortable wearing of the contact lens.

In the above formula, $R_1$ of the tertiary amine oxide represents an alkyl group having 12–18 carbon atoms, such as a lauryl group, myristyl group or stearyl group. In particular, the lauryl group is preferably employed. Each of $R_2$ and $R_3$ in the above formula represents an alkyl or hydroxyalkyl group having 1–2 carbon atoms, $R_2$ and $R_3$ being in the same group or in different groups. For example, a methyl group, ethyl group or hydroxyethyl group is employed as $R_2$ or $R_3$ in the present invention.

As the anionic surface active agent, any known material may be suitably employed as long as it is in the form of a triethanolamine salt. In the present invention, a triethanolamine salt of alkylbenzenesulfonic acid, alkyl sulfuric acid, polyoxyethylene alkyl ether sulfuric acid or alkyl glutamic acid is preferably used as the anionic surface active agent, for assuring a sufficient cleaning effect with respect to the stain adhering to the contact lens surfaces.

The present cleaning solution contains the tertiary amine oxide or oxides (at least one first component) and the anionic surface active agent or agents each in the form of the triethanolamine salt (at least one second component) in a total amount of 0.1–20% by weight, more preferably 0.5–10% by weight, with respect to the entire amount of the cleaning solution. If the total amount of the at least one first component and the at least one second component is smaller than 0.1% by weight, the cleaning solution does not exhibit a satisfactory cleaning effect since the concentration of the surface active agents in the cleaning solution is too low. On the other hand, if the total amount of the at least one first component and the at least one second component exceeds 20% by weight, the concentration of the surface active agents in the cleaning solution is too high, adversely influencing the contact lens and deteriorating touch of the cleaning solution as felt by the user.

The ratio by weight of the at least one first component with respect to the at least one second component included in the cleaning solution is held in a range of 1/4–30/1, more preferably, in a range of 3/2–20/1. If the ratio is smaller than 1/4, in other words, the amount of the tertiary amine oxide or oxides is too small with respect to that of the anionic surface active agent or agents, or if the ratio is larger than 30/1, in other words, the amount of the tertiary amine oxide or oxides is too large with respect to that of the anionic surface active agent or agents, the cleaning solution does not enjoy a synergistic effect offered by a combination of the at least one first component and the at least one second component according to the present invention. Accordingly, if the ratio does not fall within the above range, the cleaning solution shows a cleaning effect which is almost equal to or rather smaller than that of the cleaning solution which uses only one of those two kinds of surface active agents.

The cleaning solution for the contact lens prepared according to the present invention contains the tertiary amine oxide or oxides and the anionic surface active agent or agents each in the form of triethanolamine salt in the predetermined ratio, permitting the cleaning solution to exhibit an enhanced cleaning effect due to the combined use of the first and second components as described above.

The present contact lens cleaning solution may further contain, as needed, various other known components which are generally used for cleaning, in addition to the above-described first and second components, i.e., tertiary amine oxide or oxides and anionic surface active agent or agents. For instance, the cleaning solution may contain at least one component selected from among: 0–1% by weight of an isotonic component such as sodium chloride, potassium chloride or sodium bicarbonate; 0–1% by weight of a chelating agent such as sodium salt(s) of edetic acid or trihydroxymethyl aminomethane; and 0.1–10% by weight of a thickener such as propylene glycol, hydroxymethyl cellulose or polyvinylpyrrolidone. The cleaning solution may further contain at least one component selected from among: 0.1–10% by weight of a pH buffer such as borate or phosphate; 0.05–10% by weight of other various surface active agents such as anionic, cationic, amphoteric or non-ionic surface active agent; and 0.01–5.0% by weight of protease such as papain, bromelain or pancreatin. Further, the cleaning solution may contain 0.0001–1.0% by weight of a germicide or disinfectant such as potassium sorbate and sodium sorbate, benzalkonium chloride and other quaternary ammonium salt, guanidine salt such as chlorhexidine and polyhexamethylene biguanide, or formaldehyde donor. It is noted that the above-described components are added to the cleaning solution so as not to adversely influence the cleaning effect provided by the cleaning solution according to the present invention. It is further noted that any other components may be added to the cleaning solution provided that the components are generally employed for a cleaning solution for cleaning the contact lens.

The present cleaning solution may be applied to any kinds of contact lens such as a hard contact lens mainly made of methyl methacrylate, an oxygen permeable contact lens or a non-water swellable or absorbable soft contact lens. Further, the present cleaning solution may be used irrespective of whether the contact lens is colored or non-colored.

To further clarify the principle of the present invention, there will be illustrated some examples of the invention. It is to be understood, however, that the invention is not limited to the details of the illustrated examples, but may be embodied with various changes, modifications and improvements which occur to those skilled in the art without departing from the spirit and scope of the invention defined by the attached claims.

EXAMPLE 1

There was prepared a lipid-contaminated liquid which gives the contact lens an ordinary lipid stain, by dispersing and dissolving, in 60 ml of chloroform, 10 g of beef tallow (sebum bovinum), 10 g of soybean oil, 0.25 g of triolein (available from Wako Junyaku Kogyo Kabushiki Kaisha, Japan) and 0.1 g of Sudan III (coloring matter available from Wako Junyaku Kogyo Kabushiki Kaisha, Japan). Several glass slides for a microscope (each glass slide having 76 mm length, 26 mm width and 1 mm thickness) were immersed in the above-prepared lipid-contaminated liquid so that the glass slides were soiled with the lipid included in the lipid-contaminated liquid. Subsequently, the glass slides were air-dried, so as to give test samples on which a cleaning test was conducted by using the cleaning solutions according to the present invention and comparative cleaning solutions as described below.

Next, there were prepared specimens Nos. 1–14 of the contact lens cleaning solution according to the present invention which include the surface active agents (first and second components A and B) as indicated in TABLE 1 in respective ratios which are also indicated in TABLE 1. As comparative examples, specimens Nos. 1–18 were prepared which include the surface active agents as indicated in TABLE 2 in respective ratios which are also shown in TABLE 2. It is noted that all of the cleaning solution specimens include, in addition to the surface active agents as indicated in TABLE 1 and TABLE 2, 0.25% by weight of sodium chloride as the isotonic component and 0.05% by weight of sodium edetate as the chelating agent.

The composition of each specimen was diluted by 100 times to obtain a cleaning solution for cleaning the above-prepared test samples of the glass slides soiled with the lipid. Namely, the cleaning test was conducted by using the cleaning solution in such a manner that the samples of the lipid-soiled glass slides were cleaned by each cleaning solution within one or two hours after the samples of the glass slides were air-dried. The results of the test are also shown in TABLES 1 and 2.

The test was effected by using Leenerts testing apparatus in accordance with a method as specified in JIS K-3370. Each cleaning solution was evaluated in terms of its cleaning effect on the basis of stain removal percentage which is represented by the following equation:

$$\text{stain removal percent } (\%)=\{(Y-Z)/(Y-X)\}\times\phi$$

where,

X: weight of the glass slide before immersion in the lipid-contaminated liquid

Y: weight of the glass slide soiled with the lipid

Z: weight of the glass slide after cleaning by the cleaning solution.

TABLE 1

| PRESENT INVEN- | amphoteric surface active agents [A] (wt. %) | | anionic surface active agents [B] (wt. %) | | | other surface active agents | ratio | stain removal percent |
|---|---|---|---|---|---|---|---|---|
| TION | a | b | d | e | f | (wt. %) | A/B | (%) |
| 1 | 4.0 | — | 1.0 | — | — | — | 4/1 | 100 |
| 2 | — | 4.0 | 1.0 | — | — | — | 4/1 | 98 |
| 3 | 4.0 | — | — | 1.0 | — | — | 4/1 | 99 |
| 4 | 4.0 | — | — | — | 1.0 | — | 4/1 | 99 |
| 5 | 3.0 | — | 2.0 | — | — | — | 3/2 | 94 |
| 6 | 5.0 | — | 0.5 | — | — | — | 10/1 | 97 |
| 7 | 2.0 | — | 4.0 | — | — | — | 1/2 | 88 |
| 8 | 5.0 | — | 0.2 | — | — | — | 25/1 | 85 |
| 9 | 0.8 | — | 0.2 | — | — | — | 4/1 | 83 |
| 10 | 8.0 | — | 2.0 | — | — | — | 4/1 | 97 |
| 11 | 0.2 | — | 0.05 | — | — | — | 4/1 | 82 |
| 12 | 16.0 | — | 4.0 | — | — | — | 4/1 | 98 |
| 13 | 4.0 | — | 1.0 | — | — | 1.0*1 | 4/1 | 98 |
| 14 | 4.0 | — | 1.0 | — | — | 1.0*2 | 4/1 | 97 |

a: dimethyllaurylamine oxide
b: dimethylstearylamine oxide
d: triethanolamine lauryl sulfate
e: triethanolamine lauryl ether sulfate
f: triethanolamine lauroyl glutamate
*1: sodium lauryl sulfate
*2: sodium α-olefin sulfonate

TABLE 2

| COMPAR-ATIVE | amphoteric surface active agents [A] (wt. %) | | anionic surface active agents [B] (wt. %) | other surface active agents | ratio | stain removal percent |
|---|---|---|---|---|---|---|
| EXAMPLES | a | c | d | (wt. %) | A/B | (%) |
| 1 | — | 5.0 | — | — | — | 45 |
| 2 | — | 4.0 | 1.0 | — | 4/1 | 40 |
| 3 | — | 3.0 | 2.0 | — | 3/2 | 28 |
| 4 | — | 2.0 | 4.0 | — | 1/2 | 15 |
| 5 | — | 8.0 | 2.0 | — | 4/1 | 42 |
| 6 | — | 1.0 | 0.25 | — | 4/1 | 38 |
| 7 | 4.0 | — | — | 1.0*2 | — | 20 |
| 8 | 4.0 | — | — | 1.0*1 | — | 19 |
| 9 | 4.0 | — | — | 1.0*3 | — | 9 |
| 10 | 4.0 | — | — | 1.0*4 | — | 9 |
| 11 | 4.0 | — | — | — | — | 25 |
| 12 | 4.0 | — | 0.1 | — | 40/1 | 35 |
| 13 | 1.0 | — | 5.0 | — | 1/5 | 40 |
| 14 | — | — | 5.0 | — | — | 7 |
| 15 | 0.04 | — | 0.01 | — | 4/1 | 25 |
| 16 | 4.0 | — | — | 1.0*5 | — | 5 |
| 17 | 4.0 | — | — | 1.0*6 | — | 8 |
| 18 | 4.0 | — | — | 1.0*7 | — | 3 |

a, d, *1 and *2: the same as specified in TABLE 1
c: alkyldimethylaminoethylglycine hydrochloride (ANON LG: available from Nippon Oil and Fats Co., Ltd., Japan)
*3: sodium N-lauroylsarcosinate
*4: sodium polyoxyethylene lauryl sulfate
*5: polyoxyethylene(10) laurylphenyl ether
*6: sucrose stearate
*7: polyoxyethylene · polyoxypropylene block polymer It will be apparent from the results as indicated in TABLES 1 and 2 that the contact lens cleaning solution according to the present invention exhibited a significantly enhanced cleaning effect as compared to the conventional cleaning solution. Described more specifically, the specimens Nos. 1, 11 and 14 of the cleaning solution according to the comparative examples (TABLE 2) wherein only one surface active agent is employed, the stain removal percentage is as low as several tens of percent (%). In contrast, the specimens of the cleaning solution according to the present invention (TABLE 1) exhibited considerable high values of the stain removal percentage. This means that the present cleaning solution is capable of assuring a high degree of cleaning effect. As is also apparent from TABLE 2, even though the cleaning solution according to the specimen Nos. 12, 13, 15 includes the two components A and B of the present invention (i.e., the tertiary amine oxide and the anionic surface active agent in the form of triethanolamine salt), it did not exhibit a satisfactory cleaning effect because the ratio and the total amount of the first and second components A and B included in the cleaning solution did not fall within the ranges as specified in the present invention. Accordingly, the cleaning solution assures an excellent cleaning effect only when the first and second components are included in the cleaning solution in an amount and in a ratio A/B which fall within the respective ranges as specified in the present invention. Thus, it is recognized that the contact lens cleaning solution exhibits an enhanced cleaning effect owing to the combined use of the two specific surface active agents in the predetermined manner as required by the present invention.

EXAMPLE 2

In the same manner as in EXAMPLE 1, specimens were prepared, which include the surface active agents as indicated in TABLE 3 in respective ratios which are also shown in TABLE 3. As in EXAMPLE 1, 0.25% by weight of sodium chloride as the isotonic component and 0.05% by weight of sodium edetate as the chelating agent were added to each specimen of the cleaning solution.

In the meantime, there was prepared a lipid-contaminated liquid in accordance with "ISO/TC 172/SC 7/WG N 35 Cleaning efficacy", which gives the contact lens a lipid stain similar to the lipid composition included in the tear fluid. This lipid-contaminated liquid was prepared in the following manner. Initially, 16 g of castor oil, 35 g of lanolin (available from Wako Junyaku Kogyo Kabushiki Kaisha, Japan), 5 g of oleic acid, 2 g of cetyl alcohol, 2 g of cholesterol, 30 g of cholesterol acetate, 6 g of Arlacel 85 (available from Wako Junyaku Kogyo Kabushiki Kaisha, Japan), 4 g of SPAN 85 (available from Wako Junyaku Kogyo Kabushiki Kaisha, Japan) were mixed together while they were heated so that the mixture was homogenized. Next, 0.1 g of Sudan III (coloring matter) was added to 20 g of the mixture, and the thus obtained mixture was dissolved in 60 ml of chloroform. Thus, the lipid-contaminated liquid as desired was obtained.

Subsequently, the obtained lipid-contaminated liquid was diluted by 10 times. As in EXAMPLE 1, several glass slides were immersed in the diluted lipid-contaminated liquid so that each glass slide was soiled with the lipid which is similar to the lipid generally included in the tear fluid.

A cleaning test as in EXAMPLE 1 was conducted on the above-prepared test samples of the lipid-soiled glass slides by using the specimens of the cleaning solution prepared as described above. The results of the test is shown in the TABLE 3.

TABLE 3

| | | amphoteric surface active agents [A] (wt. %) | | anionic surface active agents [B] (wt. %) | | | ratio | stain removal percent |
|---|---|---|---|---|---|---|---|---|
| | | a | c | d | e | f | A/B | (%) |
| PRESENT INVENTION | 15 | 4.0 | — | 1.0 | — | — | 4/1 | 93 |
| | 16 | 2.0 | — | 0.5 | — | — | 4/1 | 91 |
| | 17 | 3.0 | — | — | 2.0 | — | 3/2 | 89 |
| | 18 | 5.0 | — | — | 0.5 | — | 10/1 | 86 |
| | 19 | 3.0 | — | — | — | 2.0 | 3/2 | 91 |
| | 20 | 5.0 | — | — | — | 0.5 | 10/1 | 90 |
| COMPARATIVE EXAMPLES | 19 | — | 4.0 | 1.0 | — | — | 4/1 | 0 |
| | 20 | — | 4.0 | — | 1.0 | — | 4/1 | 5 |
| | 21 | — | 4.0 | — | — | 1.0 | 4/1 | 3 |

a, d, e and f: the same as specified in TABLE 1
c: the same as specified in TABLE 2

It will be understood from the results of TABLE 3 that the contact lens cleaning solution according to the present invention exhibited a high degree of cleaning effect with respect to not only the ordinary lipid stain as shown EXAMPLE 1, but also the lipid stain whose composition is similar to the lipid included in the tear fluid.

EXAMPLE 3

There will be described another cleaning test which was conducted on contact lenses for observing the cleaning effect (i.e., stain removal effect) of the cleaning solution with respect to the ordinary lipid stains.

A lipid-contaminated liquid was prepared in the following manner. Initially, 10 g of beef tallow, 10 g of soybean oil, 0.25 g of triolein and 0.1 g of Sudan III were mixed together while they were heated such that the mixture was homogenized. Then, the mixture was dissolved in a mixed solvent of ethanol and hexane (the ratio of ethanol to hexane=1:1), so as to provide a solution as the lipid-contaminated liquid, which has 10% by weight of the lipid composition.

A plurality of oxygen permeable contact lenses ("MENICON SUPER EX" available from Menicon Co., Ltd) were immersed in the above prepared lipid-contaminated solution so that the surfaces of the contact lenses were soiled with the lipid stain. Subsequently, these lipid-soiled contact lenses were dried for 20 minutes under a reduced pressure at the room temperature so that the test samples of the lipid-soiled contact lens were obtained.

In the same manner as in EXAMPLE 1, there were prepared specimens of the contact lens cleaning solution which include the surface active agents as indicated in TABLE 4 and TABLE 5, respectively, in respective ratios which are also shown in TABLES 4 and 5. As in EXAMPLE 1, each specimen of the cleaning solution includes, in addition to the surface active agents as indicated in TABLES 4 and 5, 0.25% by weight of sodium chloride as the isotonic composition and 0.05% by weight of sodium edetate as the chelating agent. It is noted that the cleaning solutions Nos. 26–39 of TABLE 4 according to the present invention are the same as the cleaning solutions Nos. 1–14 of TABLE 1, respectively, while the cleaning solutions Nos. 25–42 of TABLE 4 as comparative examples are the same as the cleaning solutions Nos. 1–18 of TABLE 2.

The cleaning test was effected in such a manner that each sample of the lipid-soiled contact lens was cleaned by finger rubbing for fifteen seconds by using the above-prepared specimens of the cleaning solution as shown in TABLES 4 and 5, and was rinsed by purified water for ten seconds. Subsequently, water was removed from the surfaces of each contact lens. Then, each contact lens was observed at its surface by a microscope of 16× magnification for evaluating the degree of removal of the lipid stain by the individual specimens of the cleaning solution. The results of the evaluation are also shown in TABLES 4 and 5. The specimens of the cleaning solution were evaluated for the stain removal effect as indicated below:

-: The lipid stain did not remain on the surface of the contact lens.

±: The lipid stain remained on less than 30% of the entire surface area of the contact lens.

+: The lipid stain remained on 30–70% of the entire surface area of the contact lens.

++: The lipid stain remained over 70% of the entire surface area of the contact lens.

TABLE 4

| PRESENT INVEN- | amphoteric surface active agents [A] (wt. %) | | anionic surface active agents [B] (wt. %) | | | other surface active agents | A/B | stain removal |
|---|---|---|---|---|---|---|---|---|
| TION | a | b | d | e | f | (wt. %) | ratio | effect |
| 26 | 4.0 | — | 1.0 | — | — | — | 4/1 | - |
| 27 | — | 4.0 | 1.0 | — | — | — | 4/1 | - |
| 28 | 4.0 | — | — | 1.0 | — | — | 4/1 | - |
| 29 | 4.0 | — | — | — | 1.0 | — | 4/1 | - |
| 30 | 3.0 | — | 2.0 | — | — | — | 3/2 | - |
| 31 | 5.0 | — | 0.5 | — | — | — | 10/1 | - |
| 32 | 2.0 | — | 4.0 | — | — | — | 1/2 | - |
| 33 | 5.0 | — | 0.2 | — | — | — | 25/1 | - |
| 34 | 0.8 | — | 0.2 | — | — | — | 4/1 | - |
| 35 | 8.0 | — | 2.0 | — | — | — | 4/1 | - |
| 36 | 0.2 | — | 0.05 | — | — | — | 4/1 | - |
| 37 | 16.0 | — | 4.0 | — | — | — | 4/1 | - |
| 38 | 4.0 | — | 1.0 | — | — | 1.0*1 | 4/1 | - |
| 39 | 4.0 | — | 1.0 | — | — | 1.0*2 | 4/1 | - |

a, b, d, e, f, *1 and *2: the same as specified in TABLE 1

TABLE 5

| COMPAR-ATIVE | amphoteric surface active agents [A] (wt. %) | | anionic surface active agents [B] (wt. %) | other surface active agents | A/B | stain removal |
|---|---|---|---|---|---|---|
| EXAMPLES | a | c | d | (wt. %) | ratio | effect |
| 25 | — | 5.0 | — | — | — | + |
| 26 | — | 4.0 | 1.0 | — | 4/1 | + |
| 27 | — | 3.0 | 2.0 | — | 3/2 | + |
| 28 | — | 2.0 | 4.0 | — | 1/2 | ++ |
| 29 | — | 8.0 | 2.0 | — | 4/1 | + |
| 30 | — | 1.0 | 0.25 | — | 4/1 | + |
| 31 | 4.0 | — | — | 1.0*2 | — | + |
| 32 | 4.0 | — | — | 1.0*1 | — | + |
| 33 | 4.0 | — | — | 1.0*3 | — | ++ |
| 34 | 5.0 | — | — | 1.0*4 | — | ++ |
| 35 | 4.0 | — | — | — | — | + |
| 36 | 1.0 | — | 0.1 | — | 40/1 | + |
| 37 | — | — | 5.0 | — | 1/5 | + |
| 38 | — | — | 5.0 | — | — | ++ |
| 39 | 0.04 | — | 0.01 | — | 4/1 | + |
| 40 | 4.0 | — | — | 1.0*5 | — | ++ |

TABLE 5-continued

| COMPARATIVE EXAMPLES | amphoteric surface active agents [A] (wt. %) a | c | anionic surface active agents [B] (wt. %) d | other surface active agents (wt. %) | A/B ratio | stain removal effect |
|---|---|---|---|---|---|---|
| 41 | 4.0 | — | — | 1.0*6 | — | ++ |
| 42 | 4.0 | — | — | 1.0*7 | — | ++ |

a and d: the same as specified in TABLE 1
c: the same as specified in TABLE 2
*1 and *2: the same as specified in TABLE 1
*3–*7: the same as specified in TABLE 2

EXAMPLE 4

The cleaning test as in EXAMPLE 3 was conducted on the contact lenses which were soiled with the lipid whose composition is similar to the lipid generally included in the tear fluid, for observing the cleaning effect (i.e., the stain removal effect) of the cleaning solution according to the present invention.

There was prepared a lipid-contaminated liquid in the following manner. Initially, 16 g of castor oil, 35 g of lanolin, 5 g of oleic acid, 2 g of cetyl alcohol, 2 g of cholesterol, 30 g of cholesterol acetate, 6 g of Arlacel 85 and 4 g of SPAN 85 were mixed together while they were heated so that the mixture was homogenized. Next, 0.1 g of Sudan III (coloring matter) was added to 20 g of the mixture. The thus obtained mixture was again homogenized while it was heated and then, it was dissolved in a mixed solvent of ethanol and hexane (the ratio of ethanol to hexane=1:1), so as to provide a solution as the lipid-contaminated liquid which has 10% by weight of the lipid composition similar to the lipid included in the tear fluid.

In the same manner as in EXAMPLE 3, samples of the lipid-soiled contact lens were obtained by immersing several oxygen permeable contact lenses in the above-prepared lipid-contaminated solution.

In the same manner as in EXAMPLE 1, there were prepared specimens of the cleaning solution which include the surface active agents as indicated in TABLE 6 in respective ratios also indicated in TABLE 6. As in EXAMPLE 1, there were added 0.25% by weight of sodium chloride as the isotonic component and 0.05% by weight of sodium edetate as the chelating agent to each specimen of the cleaning solution. It is noted that the cleaning solutions Nos. 40–45 of TABLE 6 according to the present invention are the same as the cleaning solutions Nos. 15–20 of TABLE 3, respectively, while the cleaning solutions Nos. 43–45 of TABLE 6 as comparative examples are the same as the cleaning solutions Nos. 19–21 of TABLE 3.

The cleaning test was conducted on the samples of the lipid-stained contact lens prepared as described above by using the thus prepared specimens of the cleaning solution in the same manner as in the EXAMPLE 3. The specimens of the cleaning solution were evaluated for the cleaning effect in the same manner as in the EXAMPLE 3.

TABLE 6

| | | amphoteric surface active agents [A] (wt. %) a | c | anionic surface active agents [B] (wt. %) d | e | f | ratio A/B | stain removal effect |
|---|---|---|---|---|---|---|---|---|
| PRESENT INVENTION | 40 | 4.0 | — | 1.0 | — | — | 4/1 | – |
| | 41 | 2.0 | — | 0.5 | — | — | 4/1 | – |
| | 42 | 3.0 | — | — | 2.0 | — | 3/2 | – |
| | 43 | 5.0 | — | — | 0.5 | — | 10/1 | – |
| | 44 | 3.0 | — | — | — | 2.0 | 3/2 | – |
| | 45 | 5.0 | — | — | — | 0.5 | 10/1 | – |
| COMPARATIVE EXAMPLES | 43 | — | 4.0 | 1.0 | — | — | 4/1 | ++ |
| | 44 | — | 4.0 | — | 1.0 | — | 4/1 | ++ |
| | 45 | — | 4.0 | — | — | 1.0 | 4/1 | ++ |

a, d, e and f: the same as specified in TABLE 1
c: the same as specified in TABLE 2

As is apparent from the results of EXAMPLE 3 as shown in TABLES 3 and 4 and the results of EXAMPLE 4 as shown in TABLE 6, the contact lens cleaning solution according to the present invention exhibited an excellent cleaning effect with respect to the ordinary lipid stains and the stains whose composition is similar to the lipid which is usually included in the tear fluid and may adhere to the contact lenses. Thus, it will be readily understood that the present cleaning solution is capable of dealing with various kinds of stains which may adhere to the surfaces of the contact lens during use thereof.

EXAMPLE 5

There have been described the tests for observing the cleaning effect exhibited by the present cleaning solution with respect to various kinds of lipid stains. Next, there will be described another cleaning test which was conducted for observing the cleaning effect exhibited by the present cleaning solution when the contact lens is soiled with a cosmetic foundation.

In the same manner as in EXAMPLE 1, specimens of the contact lens cleaning solution were prepared which include the surface active agents as shown in TABLE 7 in respective ratios also shown in TABLE 7. Each specimen of the cleaning solution includes 0.25% by weight of sodium chloride as the isotonic agent and 0.05% by weight of sodium edetate as the chelating agent.

There were prepared several oxygen permeable contact lenses similar to those as used in EXAMPLE 3. Each contact lens was measured of its degree of cloudiness or opacity. After the measurement, the surface of each contact lens was coated uniformly with a cosmetic foundation (a stick-type foundation for suntan prevention available from SONY CREATIVE PRODUCTS Co., Ltd). Subsequently, each contact lens was dried under vacuum for one hour and was left overnight. Thus, samples of the contact lens soiled with the cosmetic foundation were obtained. Then the degree of cloudiness was measured of each sample of the contact lens before the cleaning test.

The cleaning test was conducted on the thus obtained samples of the contact lens in the following manner. Initially, each contact lens was cleaned by finger rubbing for fifteen seconds by using the specimens of the cleaning solution prepared as described above, and was rinsed with purified water for ten seconds. Subsequently, water was removed from the surfaces of each contact lens, and the degree of cloudiness was measured of each sample of the contact lens. The specimens of the cleaning solution were evaluated on the basis of the stain removal percentage obtained for each sample of the contact lens according to the following equation. The results of the evaluation are shown in TABLE 7.

$$\text{stain removal percent } (\%)=\{(V-W)/(V-U)\}\times 100$$

where,

U: the degree of cloudiness of the contact lens not coated with the cosmetic foundation V: the degree of cloudiness of the contact lens coated with the cosmetic foundation W: the degree of cloudiness of the contact lens cleaned by the cleaning solution

TABLE 7

| | | amphoteric surface active agents [A] (wt. %) | | | | anionic surface active agents [B] (wt. %) | | | ratio | stain removal percent |
|---|---|---|---|---|---|---|---|---|---|---|
| | | a | b | c | g | d | e | f | A/B | (%) |
| PRESENT INVENTION | 21 | 2.0 | — | — | — | 1.0 | — | — | 2/1 | 82 |
| | 22 | 2.0 | — | — | — | — | 1.0 | — | 2/1 | 87 |
| | 23 | 2.0 | — | — | — | — | — | 1.0 | 2/1 | 83 |
| | 24 | — | 2.0 | — | — | 1.0 | — | — | 2/1 | 85 |
| | 25 | — | — | — | 2.0 | 1.0 | — | — | 2/1 | 81 |
| COMPARATIVE EXAMPLES | 22 | — | — | 2.0 | — | 1.0 | — | — | 2/1 | 38 |
| | 23 | — | — | 2.0 | — | — | 1.0 | — | 2/1 | 37 |
| | 24 | — | — | 2.0 | — | — | — | 1.0 | 2/1 | 35 |

a, b, d, e and f: the same as specified in TABLE 1
c: the same as specified in TABLE 2
g: dihydroxyethyllaurylamine oxide It is to be recognized from TABLE 7 that the contact lens cleaning solution according to the present invention assures an enhanced cleaning effect with respect to the stains of the cosmetic foundation which tend to adhere to the surfaces of the contact lens during handling thereof by the user.

What is claimed is:

1. A cleaning solution for cleaning a contact lens, said solution comprising a tertiary amine oxide represented by the following formula,

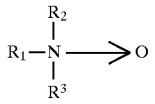

wherein $R_1$ represents an alkyl group having 12–18 carbon atoms while each of $R_2$ and $R_3$ represents an alkyl or hydroxyalkyl group having 1–2 carbon atoms, wherein $R_2$ and $R_3$ can be the same or different, and an anionic surface active agent in the form of a triethanolamine salt, the total content of said tertiary amine oxide and said anionic surface active agent being within a range of 1.0–10% by weight of the cleaning solution, wherein the ratio of said tertiary amine oxide to said anionic surface active agent ranges from 3:2 to 20:1.

2. A cleaning solution according to claim 1 wherein $R_1$ is selected from the group consisting of lauryl group, myristyl group, and stearyl group.

3. A cleaning solution according to claim 1, wherein $R_2$ and $R_3$ are selected from the group consisting of methyl group, ethyl group, and hydroxyethyl group.

4. A cleaning solution according to claim 1, wherein said anionic surface active agent is selected from the group consisting of triethanolamine salt of alkylbenzenesulfonic acid, triethanolamine salt of alkyl sulfuric acid, triethanolamine salt of polyoxyethylene alkyl ether sulfuric acid, and triethanolamine salt of alkyl glutamic acid.

5. A cleaning solution according to claim 1, wherein said cleaning solution further comprises up to 1% by weight of an isotonic component.

6. A cleaning solution according to claim 5, wherein said isotonic component is selected from the group consisting of sodium chloride, potassium chloride, and sodium bicarbonate.

7. A cleaning solution according to claim 1, wherein said cleaning solution further comprises up to 1% by weight of a chelating agent.

8. A cleaning solution according to claim 7, wherein said chelating agent is sodium salt(s) of edetic acid or trihydroxymethyl aminomethan.

9. A cleaning solution according to claim 1, wherein said cleaning solution further comprises 0.1–10% by weight of a thickener.

10. A cleaning solution according to claim 9, wherein said thickener is selected from the group consisting of propylene glycol, hydroxymethyl cellulose, and polyvinylpyrrolidone.

11. A cleaning solution according to claim 1, wherein said cleaning solution further comprises 0.1–10% by weight of a pH buffer.

12. A cleaning solution according to claim 11, wherein said pH buffer is borate or phosphate.

13. A cleaning solution according to claim 1, wherein said cleaning solution further comprises at least one anionic, cationic, amphoteric or nonionic surface active agent other than said at least one first component and said at least one second component.

14. A cleaning solution according to claim 1, wherein said cleaning solution further comprises 0.0001–1.0% by weight of a disinfectant.

15. A cleaning solution according to claim 14, wherein said disinfectant is selected from the group consisting of potassium sorbate, sodium sorbate, quaternary ammonium salt, guanidine salt, and formaldehyde donor.

16. A cleaning solution according to claim 15, wherein said quaternary ammonium salt is benzalkonium chloride.

17. A cleaning solution according to claim 15, wherein said guanidine salt is chlorhexidine or polyhexamethylene biguanide.

* * * * *